United States Patent [19]

Lawrence et al.

[11] 4,361,674

[45] Nov. 30, 1982

[54] AMINO FIBRES

[75] Inventors: Carl Lawrence, Hebden Bridge; Alan J. Hall, Rochdale; George Inverarity, Kingswinford, all of England

[73] Assignee: British Industrial Plastics Limited, Manchester, England

[21] Appl. No.: 232,218

[22] Filed: Feb. 6, 1981

[30] Foreign Application Priority Data

Feb. 9, 1980 [GB] United Kingdom ..... 8004423

[51] Int. Cl.[3] ..... C08L 61/28

[52] U.S. Cl. ..... 525/58; 264/176 F; 264/178 F; 264/185

[58] Field of Search ..... 525/58, 515, 29.4; 264/176 F, 178 F, 185

[56] References Cited

U.S. PATENT DOCUMENTS

| | | | |
|---|---|---|---|
| 4,138,445 | 2/1979 | Nogi et al. | 525/58 |
| 4,182,839 | 1/1980 | Tesson | 260/29.4 R |
| 4,250,069 | 2/1981 | Yates | 260/29.4 R |

FOREIGN PATENT DOCUMENTS

| | | |
|---|---|---|
| 1420838 | 1/1976 | United Kingdom . |
| 1452629 | 10/1976 | United Kingdom . |
| 1498848 | 1/1978 | United Kingdom . |

*Primary Examiner*—Theodore E. Pertilla

*Attorney, Agent, or Firm*—Cushman, Darby & Cushman

[57] ABSTRACT

A fibre and method of making the fibre. The fibre consists at least in part of a cationic amino-formaldehyde resin and may also include a carrier material which is a water-soluble fibre-forming polymer.

Fibres can be made by a wet-spinning method. An aqueous solution of the resin is mixed with an aqueous solution of polyvinyl alcohol to form a spinning solution and the spinning solution is extruded into a coagulation bath to form a fibre, which is dried and cured.

The cationic amino-formaldehyde resin comprises the reaction product of a triazine, optionally urea, and formaldehyde and a compound, such as di- or triethanolamine to render the resin cationic. It may be mixed with another cationic amino-formaldehyde resin, e.g. a cationic urea-formaldehyde resin, in the making of the fibre.

11 Claims, No Drawings

AMINO FIBRES

This invention relates to fibres containing aminoformaldehyde resins.

Most of the textile fibres in common use such as nylon, polyester, cellulose etc. are basically inflammable materials. Treatments have been developed to confer a degree of flame retardancy on fabrics made from such materials but it is difficult to provide a treatment which is completely satisfactory in all respects.

Thus there is an interest in developing new fibres which are inherently flame retarded.

One such proposal in U.K. Pat. No. 1,452,629 is of a flame retarded and thermally infusible fibre comprising at least 60 percent by weight of cured aminotriazine-aldehyde resin and having a degree of water swelling below 2.0. The fibres exemplified in this specification are made by spinning a solution into a hot dry atmosphere. Another such proposal in U.K. Pat. No. 1,420,838 relates to the manufacture of fibres by dry spinning a solution of a resin made from urea, optionally another monomer which can form a methylol group by the additional reaction with formaldehyde, such as melamine, and formaldehyde.

Neither of these specifications exemplify fibres made by wet spinning. U.K. Pat. No. 1,498,848 does exemplify the manufacture of fibres by wet spinning a solution of a mixture of polyvinyl alcohol and an amino resin such as a melamine/formaldehyde resin. We have found however, that it is difficult to achieve a stable spinning solution using the resins described in this specification. Furthermore, the ratio of melamine to formaldehyde in the resins in U.K. Pat. No. 1,498,848 is in the range 1:1 to 1:1.5 and more formaldehyde has to be added to cure them.

According to the present invention a fibre consists at least in part of a cationic amino-formaldehyde resin comprising the reaction product of a triazine, optionally urea, and formaldehyde, and to render said resin cationic, a compound which is at least difunctional, contains a quaternizable nitrogen atom, and can be reacted into the resin.

Preferably the fibre also comprises a carrier material which is of a water-soluble fibre-forming polymer. A particularly suitable material to use as carrier is polyvinyl alcohol.

By the expression "water-soluble fibre forming polymer" we mean a largely linear chain polymer of a high molecular weight of between 10,000 and 1 million which can easily be dissolved and extruded through fine orifices and subsequently solidified to form filaments of a fibrous nature.

The cationic amino-formaldehyde resin may be a mixture of the reaction product previously mentioned and another cationic amino resin, for example a cationic urea- formaldehyde resin, but in such cases at least half of the cationic amino-formaldehyde resin is said triazine reaction product.

One example of a cationic urea-formaldehyde resin which could be used would be a di-ethylene triamine modified urea-formaldehyde resin.

For fibre manufacture by wet-spinning the fibre comprises, by weight, at least 10%, preferably 20%, of the carrier material. The upper limit of the latter which can be included is governed by flammability since such polymers as polyvinyl alcohol are flammable, and at least 30% by weight of the amino-resin is needed to provide a degree of flame retardancy.

The preferred composition of the fibre comprises 40% to 80% by weight of the amino resin and 60% to 20% of the carrier material.

In the amino-formaldehyde resin the triazine is preferably melamine, although other triazines such as benzoguanamine may be used. The compound which renders the resin cationic may be for example an alkylene or poly alkylene polyamine, or an aliphatic hydroxylated monoamine. Cationic amino-formaldehyde resins are well-known and widely used in the paper trade, and the methods of rendering them cationic are well known and used.

Preferably the fiber is composed of 30–50% by weight polyvinyl alcohol together with a cationic amino-formaldehyde resin which is the reaction product of melamine, formaldehyde and a hydoxylated amine such as di- and tri-ethanolamine. The amount of hydroxylated monoamine in the resin is between 1 and 1.5 moles per mole of melamine. When urea is included in the reaction production a cationic urea-formaldehyde resin results in which the cationic centers are derived from diethylene triamine.

The cationic amino-formaldehyde resin may also be the reaction product of melamine, benzoguanamine, formaldehyde and a hydroxylated monoamine of the type stated above except that the ratio of hydroxylated monoamine in the resin is between 1 mole per 3 moles of triazine and 1.5 moles per mole of triazine, and the molar amount of benzoguanamine is not more than the molar amount of melamine in the resin.

The aliphatic hydroxylated monoamine may be mono- or poly-functional with respect to the hydroxyl group. It is suitably used in an amount of 0.1–2.0 moles, preferably 0.5–1.5 moles, per mole of triazine. Especially suitable are those compounds of the general formula:

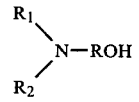

wherein R is alkylene, (preferably $(CH_2)_2$ or $(CH_2)_3$); $R_1$ is hydrogen, an alkyl group, (preferably $CH_3$ or $C_2H5$), or a hydroxyalkyl group, (preferably $(CH_2)_2OH$ or $(CH_2)_3OH$); and $R_2$ is an alkyl group (preferably $CH_3$ or $C_2H5$), or a hydroxyalkyl group (preferably $(CH_2)_2OH$ or $(CH_2)_3OH$); i.e. secondary or tertiary mono or poly-hydroxylated monoamines. Also effective are compounds where $R_1$ and $R_2$, together form an alkylene group.

The alkylene or polyalkylene polyamines which may be employed are such compounds as ethylene diamine, di-ethylene triamine, triethylene tetramine, tetraethylene pentamine, 3,3'-amino-bis-propylamine, tris-(3-aminopropyl) amine and 1,4-diaminobutane. They may be employed in similar amounts to the mono- and polyamines mentioned above.

We have found that the use of a cationic amino resin facilitates the preparation of spinning solutions for wet-spinning of the fibre.

Thus according to the present invention also a method for the manufacture of a fibre comprises preparing a spinning solution containing an aqueous solution of an uncured cationic amino-formaldehyde resin comprising the reaction product of a triazine, optionally urea, formaldehyde, and a compound which is at least difunctional, can be reacted into the resin, and contains a quaternizable nitrogen atom, and an acid to quaternize said nitrogen atom, and an aqueous solution of polyvinyl alcohol, extruding the spinning solution into a coagulation bath to form a fibre, drying said fibre and curing said resin.

In the present invention, however, we find that the use of the cationic resins greatly facilitates the formation of a relatively stable spinning solution which is most important if consistent fibre is to be produced. By relatively stable we mean in this context a solution whose viscosity remains substantially constant for long enough to permit it to be wet-spun into fibres. If changes in viscosity take place during the spinning then fibres of constant diameter and properties are very difficult to attain, and excessive filament breakages are likely to arise.

The spinning solutions made from the cationic amino resins utilize an aqueous solution of the resin, to which is added an acid, such as hydrochloric acid or formic acid, which complexes at the cationic sites on the resin whilst remaining in solution. Obviously an acid which forms an insoluble complex at this stage is not to be used. Methanol or another water-soluble alcohol, may also be added as an aid to stability.

The resin solution is mixed with an aqueous solution of thermoplastic fibre former e.g. polyvinyl alcohol, (N.B. the acid may be added to the resin solution in the solution of fibre former if desired) and the solution is aged (allowed to stand) until its viscosity is suitable for spinning e.g. about 1 to 10 poise. The viscosity range which is acceptable depends upon the pressure at which the solution can be extruded into the coagulating bath, the higher the pressure which can be used, the higher being the viscosities which are acceptable. It is to be understood that when the ageing takes place the viscosity of the solution slowly increases. If left too long the solution will reach a stage where its viscosity change increases in rate rapidly. Clearly to be useful its viscosity should be at a spinnable level at a time which leaves enough time for the spinning step before the stage is reached where the rate of change of viscosity rapidly increases. It is an advantage of the spinning solutions prepared from cationic resins as described above that this desired situation can be readily achieved. It should be noted that the concentration of acid in the spinning solution has a marked effect on the rate of change of viscosity, which also varies from resin to resin. The acid concentration can however, be readily adjusted to an appropriate value by chemists familiar with these resins.

The solution of polyvinyl alcohol may include a small amount of a boron compound. e.g. borax, or boric acid, which will improve the spinnability of the solution, i.e. reduces the breakage rate during coagulation and washing in wet-spinning. The amount of boron compound may be 0 to 5% by weight of the total amount of polyvinyl alcohol.

The solids content of the spinning solution which can be used will depend largely upon the viscosity which is acceptable for spinning, higher solids contents in general giving higher viscosities, but the components of the fibre are in substantially the same proportions in the spinning solution as is intended in the fibre to be produced. The latter requires that there is to be little or no leaching out of the resin during washing of the fibres before curing and we have found this to be so with the cationic resins described below in the Examples in this specification.

A spinning solution of an acceptable viscosity is wet-spun into fibres by extruding it through a spinneret into a coagulating bath. The latter will contain a concentrated salt solution, optionally containing also an alkali, a commonly used bath being one containing Sodium Hydroxide and Sodium Sulphate.

The fibres are led from the coagulation bath, drawn whilst still wet, washed in water and dried. They may then be further drawn by hot-drawing if desired, and are finally cured.

In the present invention curing may be achieved simply by heating the fibre; there is no need to treat it with more formaldehyde.

The invention will now be illustrated by means of the following Examples, Examples 3, 4 and 5 being included for comparison.

EXAMPLE 1

A polyvinyl alcohol solution containing 10% w/w polyvinyl alcohol and 2% w/w (based on polyvinyl alcohol) of boric acid was first prepared. The polyvinyl alcohol used had a degree of polymerization of 1700 and was fully hydrolysed.

The resin employed was Resin A, a triethanolamine modified melamineformaldehyde (MF) resin with a T:M:F ratio of 1:1:6 which was used as a liquid containing 38% solids.

A spinning solution was prepared by mixing the polyvinyl alcohol (PVA) solution (1,000 g) with a solution containing the resin (562 g) and hydrochloric acid (500 g of 0.23 M). This spinning solution contained 15.2% dissolved solids with a MF:PVA ratio of 68:32. After 24 hours standing at 20° C. its viscosity was 2.1 poise.

The spinning solution was extruded through a spinneret containing 25 holes of 75u diameter into a coagulation bath containing 260 g/l sodium sulphate and 8 g/l sodium hydroxide at 30° C. The coagulated filaments were drawn in air (1.24×) and in a bath at 60° C. containing sodium sulphate (300 g/l) and sulphuric acid (5 g/l) to a total draw ratio of 4.1×. The filaments were finally washed with water and dried in warm air.

These as-spun fibres were white in colour. Their fineness was 5.6 dtex/filament, tenacity 0.85 gpdtex and extensibility 40%. Their nitrogen content was 14.1%, compared with a calculated nitrogen content of 14.7% showing that negligible resin loss had occurred during coagulation and washing.

A number of the as-spun fibres were cured at 138° C. in air for 17 hours giving cured fibres, which were yellow in colour. On placing in a flame they ignited but extinguished immediately on removal from the flame. Their fineness was 5.0 dtex/filament, tenacity 1.4 gpdtex and extensibility 8%.

The remaining as-spun fibres were drawn 1.9 times at 175° C. and cured at 138° C. in air for 17 hrs. The cured fibres were yellow in colour. On placing in a flame they ignited, but extinguished immediately on removal from the flame. Their fineness was 2.4 dtex/filament, tenacity 2.23 gpdtex and extensibility 8%.

EXAMPLE 2

A spinning solution was prepared as in example 1. Its viscosity prior to spinning was 1.9 poise. The solution was extruded through a spinneret containing 100 holes of 125u diameter into a coagulation bath containing 230 g/l sodium sulphate and 8 g/l sodium hydroxide at 30°

C. The coagulated filaments were drawn in air (1.5×) and in a bath at 60° C. containing sodium sulphate (300 g/l) and sulphuric acid (5 g/l) to a total draw ratio of 5.0×. The filaments were finally washed and dried.

The as-spun fibre was cured in air at 128° C. for 16 hours giving a self-extinguishing, non-melting fibre. The fibres had a fineness of 2.6 dtex/filament, a tenacity of 1.4 gpdtex and an extension of 15%.

Their limiting oxygen index was 30%.

EXAMPLE 3

A spinning solution was prepared as for example 1 except that water was used in place of hydrochloric acid as the diluent. The solution had a viscosity of 4.1 poise after 2 days' ageing, and was stable indefinitely. It was very difficult to spin into fibres mainly due to difficult coagulation, ie coagulation was rapid, causing many filament breaks. This example shows the importance of adding hydrochloric acid to obtain good spinnability.

EXAMPLE 4

An aqueous solution of PVA was prepared containing 8% w/w PVA and 2% w/w (based on PVA) of boric acid. The PVA used had a degree of polymerisation of 1700 and was fully hydrolysed.

To 131 g of the PVA solution was added 13 g of water and after mixing the resulting solution was stood for 15 min at room temperature before blending with a liquid MF resin (37 g of 70% solution of Resin B) and water (40 g). The spinning solution, therefore, contained 16.3% dissolved solids with an MF:PVA ratio of 70:30. After 24 hours ageing at 20° C. its viscosity was 37 poise. The resin B is a methylated melamine-formaldehyde resin (M:F-MeO ratio 1:4.5:2.5) and is not a cationic resin.

Although of a spinnable viscosity, it was very difficult to spin this spinning solution into fibres due to poor coagulation causing many filament breaks. The fibres so produced also tended to stick together.

EXAMPLE 5

An aqueous solution of PVA was prepared as in example 4.

To 131 g of the PVA solution was added formaldehyde (13 g of 37% aqueous solution). After mixing, the resulting solution was stood for 15 minutes at room temperature before blending with a liquid MF resin (37 g of 70% solution of Resin B) and water (40 g). The spinning solution therefore contained 16.5% dissolved solids with an MF:PVA ratio of 69:31. After 24 hours aging at 20% its viscosity was 17 poise. This solution remained spinnable for several weeks.

The above solution was degassed and filtered before extruding through a spinneret containing 10 holes of 125u diameter into a coagulation bath containing sodium sulphate (230 g/l) and sodium hydroxide (30 g/l) at 30° C. The coagulated filaments were drawn 3.3× at 60° C. in a bath containing sodium sulphate (300 g/l) and sulphuric acid (5 g/l). The filaments were finally washed in water and dried in warm air.

These as-spun fibres were white in colour. Their fineness was 9.4 dtex/filament tenacity 0.6 gpdtex and extensibility 47%. Their nitrogen content was 12.3% compared with a calculated nitrogen content of 17.2% showing that resin was lost during coagulation and washing.

The as-spun fibre was drawn 1.9× at 175° C. and cured at 150° C. in air for 16 hours. The cured fibres were dark yellow, with a fineness of 4.0 dtex/filament, tenacity 1.6 gpdtex and extensibility 5%. On placing in a flame they ignited, but extinguished immediately on removal from the flame.

Comparison of this Example with Example 4 indicates that the added formaldehyde in Example 5 has facilitated preparation of a spinnable solution. However, the loss in nitrogen content indicates that over 25% of the amino-formaldehyde resin was leached out of the fibre during coagulation and washing, in contrast to Example 1, where the loss was very small.

EXAMPLE 6

A spinning solution was prepared using PVA solution prepared in example 1 (480 g) which was blended with hydrochloric acid (80 ml of 0.229 M), resin A (126.5 g) and water (113.6 g). The resulting solution containing 12% total solids with a MF/PVA ratio of 50:50 and an acid content of $4\times10^{-4}$ mole per gramme of resin. The solution was aged for 10 days at 25° C. when its viscosity had increased to 6.5 poise prior to spinning.

The solution was extruded through a spinneret containing 20 holes of 125u diameter into a coagulation bath containing sodium sulphate (230 g/l) and sodium hydroxide (30 g/l) at 30° C. The coagulated filaments were stretched in air (2.1×) and in a bath at 60° C. containing sodium sulphate (300 g/l) and sulphuric acid (10 g/l) to a total stretch of 7.0×.

The filaments were finally washed with water and dried with warm air.

The as-spun fibre was cured in air at 132° C. for 18 hours giving a self extinguishing fibre with a limited oxygen index of ca. 24.5%. The fibres had a fineness of 5.0 dtex/filament, a tenacity of 1.75 gpdtex and an extension of 7%.

Preparation of Examples 7–10

EXAMPLE 7

Resin C was prepared as follows:

Formalin (212.4 g of a 36% aqueous solution i.e. an aqueous solution of formaldehyde containing 36% by weight formaldehyde), 90% triethanolamine (130.4 g) and 91% paraform (20.5 g) were charged into a reaction flask equipped with a reflux condenser, thermometer and stirrer. The flask was heated to 85°–90° C. and maintained at this temperature for 2 hours. After cooling to about 50° C., melamine (98.7 g) was added. The flask was reheated to 85°–90° C. and formic acid (9.5 g of an 85% aqueous solution) added slowly. The temperature was maintained, and after 30 mins the pH of the solution was 7.9. The temperature was reduced to 70°–80° C. and maintained until the viscosity was 16A–17A (P.R.S. tubes at 25° C.). Water (117.8 g) was added and the mixture heated at 70°–80° C. until the viscosity was 16A–17A (P.R.S. tubes at 25° C.). The contents of the flask were cooled, water (402.3 g) and formic acid (19.4 g of a 85% aqueous solution) were added: The pH, solids content and viscosity were 7.0, 24.3% and 0.992 p respectively.

The preparation of resins of this type is described and claimed in U.K. Pat. No. 1,305,187.

EXAMPLES 8 and 9

The procedure described in example 7 was followed to prepare Resins D and E using the quantities shown in Table 1.

TABLE 1

| | Example | Resin D | Resin E |
|---|---|---|---|
| 36% | formalin | 185.3 g | 664.5 g |
| 90% | triethanolamine | 147.1 g | 416.1 g |
| 91% | paraform | 73.3 g | 65.5 g |
| | melamine | 111.8 g | 316.2 g |
| 85% | formic acid (i) | 13.2 g | 37.3 g |
| 85% | formic acid (ii) | 13.2 g | 37.3 g |
| | water (i) | 103.7 g | 105.2 g |
| | water (ii) | 352.5 g | 358.3 g |

The properties of the resulting resins are shown in Table 2.

TABLE 2

| Example | Resin D | Resin E |
|---|---|---|
| pH | 7.2 | 7.3 |
| solids | 31% | 41% |
| viscosity (p) | 1.432 | 13.92 |

EXAMPLE 10

The procedure described in Example 7 was followed to prepare Resin F substituting diethanolamine for triethanolamine and using the quantities shown in Table 3.

TABLE 3

| | | |
|---|---|---|
| 36% | formalin | 170.5 g |
| | diethanolamine | 71.6 g |
| 91% | paraform | 67.4 g |
| | melamine | 86.0 g |
| 85% | formic acid (i) | 10.1 g |
| | formic acid (ii) | 10.1 g |
| | water (i) | 102.6 g |
| | water (ii) | 350.2 g |

The pH, solids content and viscosity of the resulting resin F were 7.3, 22% and 0.369 p respectively.

Spinning of Examples 7–10

EXAMPLE 7

The spinning solution was prepared by mixing PVA solution prepared as in Example 1 (100 g) with the resin C (73.1 g), hydrochloric acid (9.9 ml of 0.225 M) and water (22.6 ml). The solution therefore contained 15% solids with a MF/PVA ratio of 68:32. It was allowed to stand at 25° C. overnight to de-gas, when its viscosity was 3.0 poise. The solution was extruded using a spinneret containing 20 holes of 125u diameter, with spinning conditions as in Example 2.

The as-spun fibre was cured at 132° C. for 18 hours giving a self-extinguishing non-melting fibre having a fineness of 6.3 dtex/filament, a tenacity of 2.3 gpdtax and an extension of 10%.

EXAMPLE 8

The spinning solution was prepared by mixing PVA solution prepared as in example 1 (200 g) with the prepared resin D (112.4 g), hydrochloric acid (19.8 ml of 1.155 M), and water (78.4 ml). The solution therefore contained a total solids content of 15% with a MF/PVA ratio of 68:32. The solution viscosity was 5.6 poise after 2 hours at 25° C. The solution was spun into fibres as described in Example 7.

The as-spun fibre was cured at 132° C. for 18 hours giving a self-extinguishing, non-melting fibre with a fineness of 11.3 dtex/filament, tenacity 1.7 gpdtex and extension 13%.

EXAMPLE 9

The spinning solution was prepared by mixing PVA solution prepared as in Example 1 (100 g) with the resin E (42.2 g) hydrochloric acid (9.9 ml of 1.155 M) and water (53 g). After standing at 25° C. for 1 day its viscosity was 3.5 poise.

The solution was extruded through a spinneret containing 20 holes of 125u diameter and conditions as in Example 1. The as-spun fibres were cured at 132° C. for 18 hours giving fibres which were off white, self-extinguishing, non-melting, and having a limited oxygen index of 31%. Their fineness was 8.0 dtex/filament, tenacity 2.2 gpdtex and extension 10%.

EXAMPLE 10

The spinning solution was prepared by mixing PVA solution prepared as in Example 1 (100 g) with the prepared resin F (73.1 g), hydrochloric acid (15 ml of 0.226 M), and water (17.6 ml). The solution contained 15% total solids with a MF/PVA ratio of 68:32, and had a viscosity of 3.1 poise prior to spinning. The solution was extruded through a spinneret containing 10 holes of 125u diameter using conditions as in Example 1.

The as-spun fibre was cured at 132° C. for 18 hours giving a self-extinguishing non-melting fibre with a limited oxygen index of 729.2%. The cured fibre had a fineness of 6.2 dtex/filament, a tenacity of 1.8 gpdtex and an extension of 7%.

Effect of Acid Content on Gelling Time of Spinning Solution

Experiments were carried out to determine the effect in the spinning solution of acid content on gelling time and rate of viscosity increase. A series of solutions were prepared containing 12% total solids with a MF:PVA ratio of 50:50. The resin used was Resin A and the acid was hydrochloric acid.

Acid contents were recorded as moles of acid per gramme of reactive resin and the change of viscosity with time was measured for solutions of various acid contents.

The results obtained are shown below in Table 4.

TABLE 4

| Acid Content | | Time (hours) to reach | | | Gel |
|---|---|---|---|---|---|
| Mole HCl/g resin | Induction Period* | 2.5 poise | 3 poise | 5 poise | Time hours |
| $4 \times 10^{-4}$ | 90 | 150 | 170 | 200 | 300 |
| $4.5 \times 10^{-4}$ | 35 | 62 | 78 | 95 | 150 |
| $5 \times 10^{-4}$ | 22 | 37 | 43 | 58 | 85 |
| $6 \times 10^{-4}$ | 0 | 8 | 14 | 22 | 30 |
| $7 \times 10^{-4}$ | 0 | 4 | 6 | 12 | 18 |

*The induction period is the time taken by the solution to reach 2 poises, taken as spinnable viscosity.

It can be seen that the rate of viscosity increase is much greater at the higher acid contents despite the small actual changes in acid content.

EXAMPLES 11-17

Spinning solutions were prepared using PVA solution prepared as in example 1 (100 g), which was blended with hydrochloric acid (0.225 M), amino resin and water. The resins and quantities of the components used are shown in table 5. The solutions were aged at 25° C. until they reached the viscosities indicated in table 6. The solutions were spun as in example 6, the spinneret size and total stretch used for each example being indicated in table 6. The as-spun fibres were cured in air at 138° C. for 17 hrs giving self-extinguishing fibres with properties as shown in table 6.

The amino resins used were Resin G—a triethanolamine modified melamine/urea/formaldehyde resin, solids content 38%), and Resin H (a diethylene-triamine modified urea/formaldehyde resin). Resins I and J are benzoguanamine/melamine/formaldehyde/triethanolamine (0.2:0.8:6:1 and 0.5:0.5:6:1 respectively) resins prepared following the procedure used for examples 7-10. The pH, solids content and viscosity of Resin I were 7.3, 28.6% and 0.711 p respectively, and of Resin J were 7, 37% and 1.400 p respectively.

TABLE 5

| Example Number | Amino Resin Composition | Resin:PVA | Mol H+ Resin Solids | $H_2O$ | Total Solids Content (%) |
|---|---|---|---|---|---|
| 11 | Resin G (100%) | 70:30 | 3.9 | 19.2 | 15 |
| 12 | Resin A/Resin G (50:50) | 70:30 | 0.9 | 49.5 | 15 |
| 13 | Resin A/Resin G (75:25) | 70:30 | 0.9 | 41.4 | 15 |
| 14 | Resin A/Resin H (75:25) | 70:30 | 1.9 | 41.4 | 15 |
| 15 | Resin A/Resin H (90:10) | 70:30 | 3.9 | 0 | 17 |
| 16 | Resin I/ (100%) | 70:30 | 2.9 | 30.8 | 15 |
| 17 | Resin J/ (100%) | 70:30 | 3.9 | 30.9 | 15 |

TABLE 6

| Example Number | Viscosity of Dope (p) | Spinneret | Total Stretch | dtex/fil | tenacity g/dtex | elongation at break (%) |
|---|---|---|---|---|---|---|
| 11 | 3.1 | 20 × 125 u | 3.25 | 2.95 | 1.37 | 8.3 |
| 12 | 3 | 10 × 125 u | 3.39 | 5.1 | 1.57 | 7.1 |
| 13 | 2.7 | 20 × 125 u | 3.27 | 1.55 | 1.36 | 8.5 |
| 14 | 2.7 | 10 × 125 u | 3.68 | 4.0 | 1.45 | 11.1 |
| 15 | 3.9 | 25 × 100 u | 4.65 | 1.88 | 1.96 | 7.0 |
| 16 | 2.8 | 50 × 125 u | 3.4 | 1.6 | 1.16 | 7 |
| 17 | 2.9 | 10 × 125 u | 3.5 | 4.4 | 1.17 | 3.6 |

EXAMPLE 18

A spinning solution was prepared using PVA solution prepared in example 1 (100 g) which was blended with formic acid (34.4 ml of 0.196 M), resin A (60.2 g) and water (25.9 ml). The resulting solution contained 15% total solids with a MF/PVA ratio of 70:30 and an acid content of $2.9\times10^{-4}$ mole per gramme of resin. The solution was aged for 18 days at 25° C. when its viscosity had increased to 3.2 poise prior to spinning.

The solution was spun as in example 6 using a 10×125u spinnerette, the total stretch being 3.09. The as-spun fibre was cured in air at 138° C. for 17 hrs giving a self-extinguishing non-melting fibre having a fineness of 8.3 dtex/filament, a tenacity of 1.2 g/dtex and an extension of 8%.

We claim:

1. A fibre consisting at least in part of a cationic amino-formaldehyde resin comprising the reaction product of a triazine, optionally urea, and formaldehyde, and to render said resin cationic, a compound which is at least difunctional, contains a quarternizable nitrogen atom and can be reacted into the resin together with a carrier material which is of a water-soluble fibre-forming polymer.

2. A fibre according to claim 1 in which said carrier material is polyvinyl alcohol.

3. A fibre according to claim 1, which comprises also a cationic urea-formaldehyde resin the amount of which is not greater than said resin comprising a triazine.

4. A fibre according to claim 3 in which the urea-formaldehyde resin is urea-formaldehyde resin incorporating di-ethylene triamine to render the resin cationic.

5. A fibre according to claim 1 or 3 whose composition comprises 40% to 80% by weight of amino-resin and 60% to 20% by weight of the carrier material.

6. A fibre according to claim 1 in which said triazine comprises melamine.

7. A fibre according to claim 1 in which the compound which renders the compound cationic is di-or tri-ethanolamine.

8. A fibre according to claim 1 comprises polyvinyl alcohol, and a cationic amino-formaldehyde resin which is the reaction product of melamine, formaldehyde and a hydroxylated mono-amine selected from the group consisting of di- and tri-ethanolamine, the amount of hydroxylated monoamine in said resin being between one mole per 3 moles of melamine and 1.5 moles per mole of melamine, and the amount of polyvinyl alcohol in said fibre being in the range 30 to 50% by weight.

9. A fibre according to claim 1 which comprises polyvinyl alcohol, and a mixture of a cationic amino-formaldehyde resin which is the reaction product of melamine, formaldehyde and a hydroxylated monoamine selected from the group consisting of di- and tri-ethanolamine, the amount of hydroxylated monoamine in said resin being between one mole per 3 moles of melamine and 1.5 moles per mole of melamine, and a cationic urea-formaldehyde resin in which cationic centres are derived from diethylene triamine.

10. A fibre according to claim 1 which comprises polyvinyl alcohol, and a cationic amino-formaldehyde resin which is the reaction product of melamine, benzoguanamine, formaldehyde and a hydroxylated monoamine selected from the group consisting of di- and tri-ethanolamine, the amount of hydroxylated monoamine in said resin being between one mole per 3 moles of triazine and 1.5 moles per mole of triazine, and the molar amount of benzoguanamine being not more than the molar amount of melamine in said resin.

11. A fibre according to claim 1 comprising polyvinyl alcohol and a cationic amino-formaldehyde resin which is the reaction product of melamine, urea, formaldehyde and a hydroxylated monoamine selected from the group consisting of di- and tri-ethanolamine, the molar amount of urea in said resin being not greater than the molar amount of melamine.

* * * * *